United States Patent [19]

Kaneko

[11] Patent Number: 5,038,661

[45] Date of Patent: Aug. 13, 1991

[54] WAVEFORM GENERATOR FOR ELECTRONIC MUSICAL INSTRUMENT

[75] Inventor: Yoji Kaneko, Tokyo, Japan

[73] Assignee: Casio Computer Co., Ltd., Tokyo, Japan

[21] Appl. No.: 294,901

[22] Filed: Jan. 5, 1989

Related U.S. Application Data

[63] Continuation of Ser. No. 2,121, Jan. 12, 1987, abandoned.

[30] Foreign Application Priority Data

Jan. 31, 1986 [JP] Japan ..... 61-19845
Mar. 14, 1986 [JP] Japan ..... 61-55008

[51] Int. Cl.[5] ..... G10H 7/00

[52] U.S. Cl. ..... 84/607; 84/604; 84/622; 84/624; 84/625; 84/627

[58] Field of Search ..... 84/604, 607, 622, 624–627, 84/DIG. 10

[56] References Cited

U.S. PATENT DOCUMENTS

| | | | |
|---|---|---|---|
| 3,443,463 | 5/1969 | Campbell | 84/1.22 X |
| 3,639,913 | 2/1972 | Watson | 340/172.5 |
| 3,809,786 | 5/1974 | Deutsch | 84/1.01 |
| 3,882,751 | 5/1975 | Tomisawa et al. | 84/1.01 |
| 3,978,755 | 9/1976 | Woron | 84/1.24 |
| 4,018,121 | 4/1977 | Chowning | 84/1.01 |
| 4,134,321 | 1/1979 | Woron | 84/1.19 X |
| 4,138,915 | 2/1979 | Nagai et al. | 84/1.22 |
| 4,212,221 | 7/1980 | Woron | 84/1.13 X |
| 4,246,822 | 1/1981 | Deutsch | 84/1.01 |
| 4,249,447 | 2/1981 | Tomisawa | 84/1.23 X |
| 4,262,573 | 4/1981 | Chibana | 84/1.19 X |
| 4,281,574 | 8/1981 | Deutsch | 84/1.22 X |
| 4,297,933 | 11/1981 | Nishimoto | 84/1.19 X |
| 4,554,857 | 11/1985 | Nishimoto | 84/1.19 |
| 4,597,318 | 7/1986 | Nikaido et al. | 84/1.01 X |
| 4,616,546 | 10/1986 | Uchiyama . | |
| 4,641,564 | 2/1987 | Okamoto | 84/1.19 X |
| 4,655,115 | 4/1987 | Nishimoto | 84/1.19 |
| 4,658,691 | 4/1987 | Ishibashi . | |
| 4,683,793 | 8/1987 | Deutsch | 84/1.23 X |
| 4,747,332 | 5/1988 | Uchiyama et al. . | |
| 4,813,326 | 3/1989 | Hirano et al. | 84/624 |

FOREIGN PATENT DOCUMENTS

| | | |
|---|---|---|
| 58-65492 | 4/1983 | Japan . |
| 58-128495 | 8/1983 | Japan . |
| 58-128496 | 8/1983 | Japan . |
| 58-128497 | 8/1983 | Japan . |
| 58-128498 | 8/1983 | Japan . |
| 58-128499 | 8/1983 | Japan . |
| 58-133197 | 9/1983 | Japan . |
| 58-133198 | 9/1983 | Japan . |
| 58-133199 | 9/1983 | Japan . |

*Primary Examiner*—A. T. Grimley
*Assistant Examiner*—Matthew S. Smith
*Attorney, Agent, or Firm*—Frishauf, Holtz, Goodman & Woodward

[57] ABSTRACT

A plurality of waveforms are time-divisionally obtained from a waveform generator in one sampling period under the control of a controller. The sampling period is equally divided into a plurality of module periods. Each module period is also divided to correspond to the number of waves which are obtained time-divisionally. The waveform generator includes a selector which uses waveform data produced in a preceding module in the sampling period as that for waveform generation in the following module.

32 Claims, 10 Drawing Sheets

WAVEFORM GENERATOR FOR ELECTRONIC MUSICAL INSTRUMENT

This application is a continuation of application Ser. No. 07/002,121, filed Jan. 12, 1987, now abandoned.

BACKGROUND OF THE INVENTION

The present invention relates to a waveform generator, which generates musical tone waveforms for an electronic musical instrument.

Various methods or apparatuses for generating musical tone waveforms are known. Such methods or apparatuses include:

(A) A method or apparatus for storing a waveform corresponding to each tone color in a memory, and reading it out. More specifically, such a method or apparatus is described in U.S. Pat. No. 3,639,913 (issued on Feb. 1, 1972), U.S. Pat. No. 3,882,751 (issued on May 13, 1975), and the like.

(B) A method or apparatus for multiplying a sine wave of a fundamental frequency and a sine wave of each harmonic component with a Fourier coefficient and synthesizing resultant products to produce a waveform in accordance with a Fourier synthesis method, i.e., $$Y1 = \sum_{n=1}^{n}$$

anain $n\omega_0 t$ (where $\omega_0$ is a fundamental frequency. Such a method or apparatus is described in U.S. Pat. No. 3,809,786 (issued on May 7, 1974).

With method or apparatus (A), various waveforms cannot be stored in a memory unless the memory has a large storage capacity. More specifically, the storage capacity poses a problem. In addition, waveforms other than those stored in the waveform memory cannot be produced.

With method or apparatus (B), in order to obtain a musical tone having desired harmonic overtone components, calculations must be performed a plurality of times corresponding to the number of harmonic overtone components, or sine wave generators corresponding in number to the harmonic overtone components must be required.

In addition, the following method or apparatus is known.

(C) A method or apparatus in accordance with FM modulation.

More specifically, waveforms are produced in accordance with the following equation:

$$Y2 = A\sin(\omega_c t + I\sin\omega_m t)$$

(where $\omega_c$ is a carrier angular frequency, $\omega_m$ is an angular frequency of a modulated wave, I is a modulation index, and A is an amplitude.) Such a method or apparatus is disclosed in U.S. Pat . No. 4,018,121 (issued on Apr. 19, 1977).

With this FM modulation method, waveforms including many harmonic overtone components can be generated by a relatively small sine wave generating system. However, when resultant waveforms are evaluated in terms of their spectra, a waveform with a moderate spectrum envelope cannot be generated, and a waveform string whose spectrum distribution gradually changes, cannot be generated.

(D) A method or apparatus in accordance with a PD (phase distortion) method.

This method or apparatus relates to a content previously proposed by the present assignee (e.g., U.S. Ser. No. 788,669 filed on Oct. 17, 1985). With this method, phase angle signals for reading a sine wave stored in a single musical tone waveform memory are modified by a phase angle modifying circuit, and various waveforms such as a sawtooth wave and a sine wave can be generated.

However, in a detailed circuit arrangement for method (D), the phase angle modifying circuit is constituted by dividers, resulting in a bulky apparatus.

SUMMARY OF THE INVENTION

The present invention has been made in consideration of the above situation, and has as its principal object to provide a waveform generator for an electronic musical instrument, which can generate various waveforms by a compact circuit arrangement.

It is an object of the present invention to provide a waveform generator for an electronic musical instrument, wherein a waveform generator which generates a plurality of waveforms in a time-divisional manner, and outputs accumulated data of these waveforms as a final output for a unit sampling period is used, and preceding waveforms or accumulated waveforms generated in the same sampling period are selectively used as data for the next waveform generation, so as to obtain various waveforms.

It is another object of the present invention to provide a waveform generator for an electronic musical instrument, which can generate various waveforms having smooth spectrum envelopes with a simple arrangement.

According to the present invention, there is provided a waveform generator for an electronic musical instrument, having control means and waveform generating means for time-divisionally generating a plurality of waveforms and accumulating the waveforms in a unit sampling period to obtain a final output under the control of the control means, wherein the waveform generating means comprises a selective operation means which is selectively operated using at least one of a preceding waveform and a sum of the waveforms already generated in the same sampling period as data used for a waveform to be generated next.

According to the present invention, there is further provided a waveform generator for an electronic musical instrument, comprising:

phase angle generating means for generating phase angle data which changes at a frequency corresponding to a depressed key;

data setting means for generating control data for modifying the phase angle data;

phase angle modifying means for modifying the phase angle data in accordance with the control data and outputting modified phase angle data; and a musical tone memory whose address is designated by the output from the phase angle modifying means, wherein the phase angle updating means has shift means for bit-shifting the phase angle data in different directions using the control data, and bit-shift direction selecting means for switching the direction of bit shifting to define an inclination of the modified phase angle data as the output from the phase angle modifying means at a timing during one cycle of the waveform.

DETAILED DESCRIPTION OF THE PREFERRED EMBODIMENTS

Figure 1:
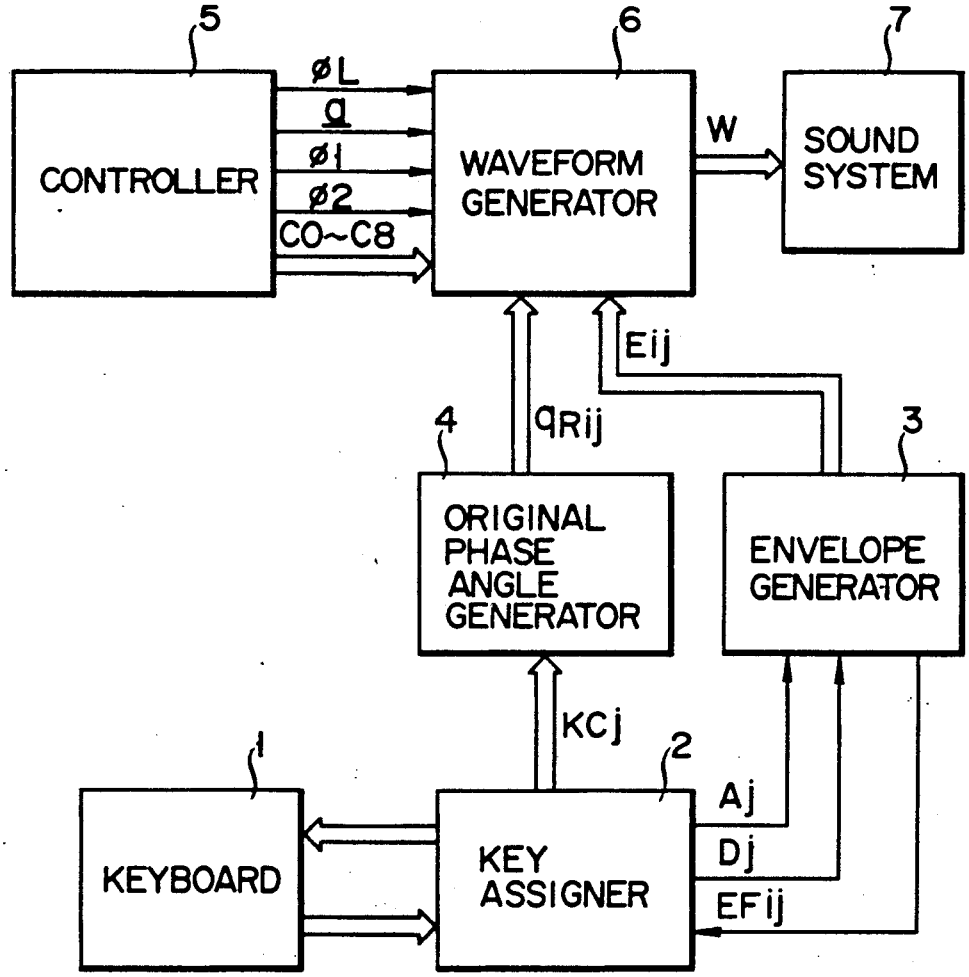
FIG. 1 is a block diagram showing an electronic musical instrument to which the present invention is applied.
Figure 2:
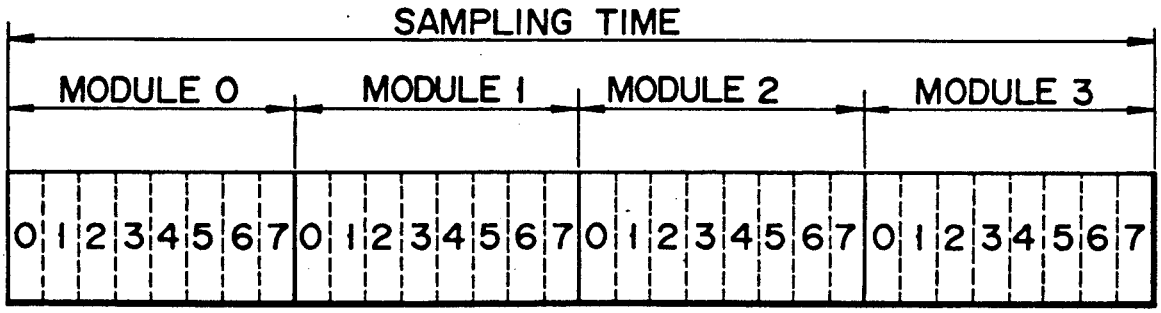
FIG. 2 is a format showing module times and channel times in one sampling period used in an embodiment.

FIG. 1 is a block diagram of an electronic musical instrument to which the present invention is applied. In this case, the electronic musical instrument is of an 8-tone polyphonic type for the sake of simplicity. On keyboard circuit 1, switches for detecting ON/OFF of keys are arranged in a matrix, and are scanned by key assigner 2. Key assigner 2 detects ON/OFF of the keys of keyboard circuit 1, and generates, upon detection of key depression, key code KC0 and attack start signal A0 corresponding to the detected key for a tone generation channel (assumed to be channel 0) which is not currently subjected to tone generation. Envelope generator 3, original phase angle generator 4, and waveform generator 6 process four series of data for each of eight tones, i.e., a total of 32 series of data. In FIG. 2, the four series are denoted as modules 0 to 3, to be assigned within one sampling period. Each module is divided into eight sections to serve as channels 0 to 7. Assuming that a sampling frequency is 50 kHz, the operating frequency is $32\times 50$ kHz $=1.6$ MHz. For the sake of simplicity, suffix for modules 0 to 3 is given by i, and suffix for channels 0 to 7 is given by j, and data Y in module i and channel j is indicated by Yij.

In response to attack start signal A0, envelope generator 3 begins to generate envelope waveform Ei0 for the four series. (Note that if the above-mentioned key is turned off, key assigner 2 generates decay start signal D0 to tone generation channel 0 to release the envelope. Envelope generator 3 generates envelope end signal EFi0 upon completion of releasing. Upon reception of envelope end signal EFi0, key assigner 2 stores that the corresponding tone generation channel is empty.) Original phase angle generator 4 receives key code KC0 from key assigner 2, and accumulates four series of frequency numbers Ri0 to generate original phase angle data qRi0. Waveform generator 6 is the main feature of the o present invention. Generator 6 receives clocks $\phi$L, a, $\phi$1, and $\phi$2 and control signals C0 to C8 from the control circuit 5, and original phase angle data qRi0, from original phase angle generator 4, and envelope Ei0 from envelope generator 3 to generate a desired waveform, and adds the waveforms for the respective channels so as to output final waveform W. Sound system 7 receives final waveform W as digital data, and D/A converts it to generate a sound.

Figure 3:
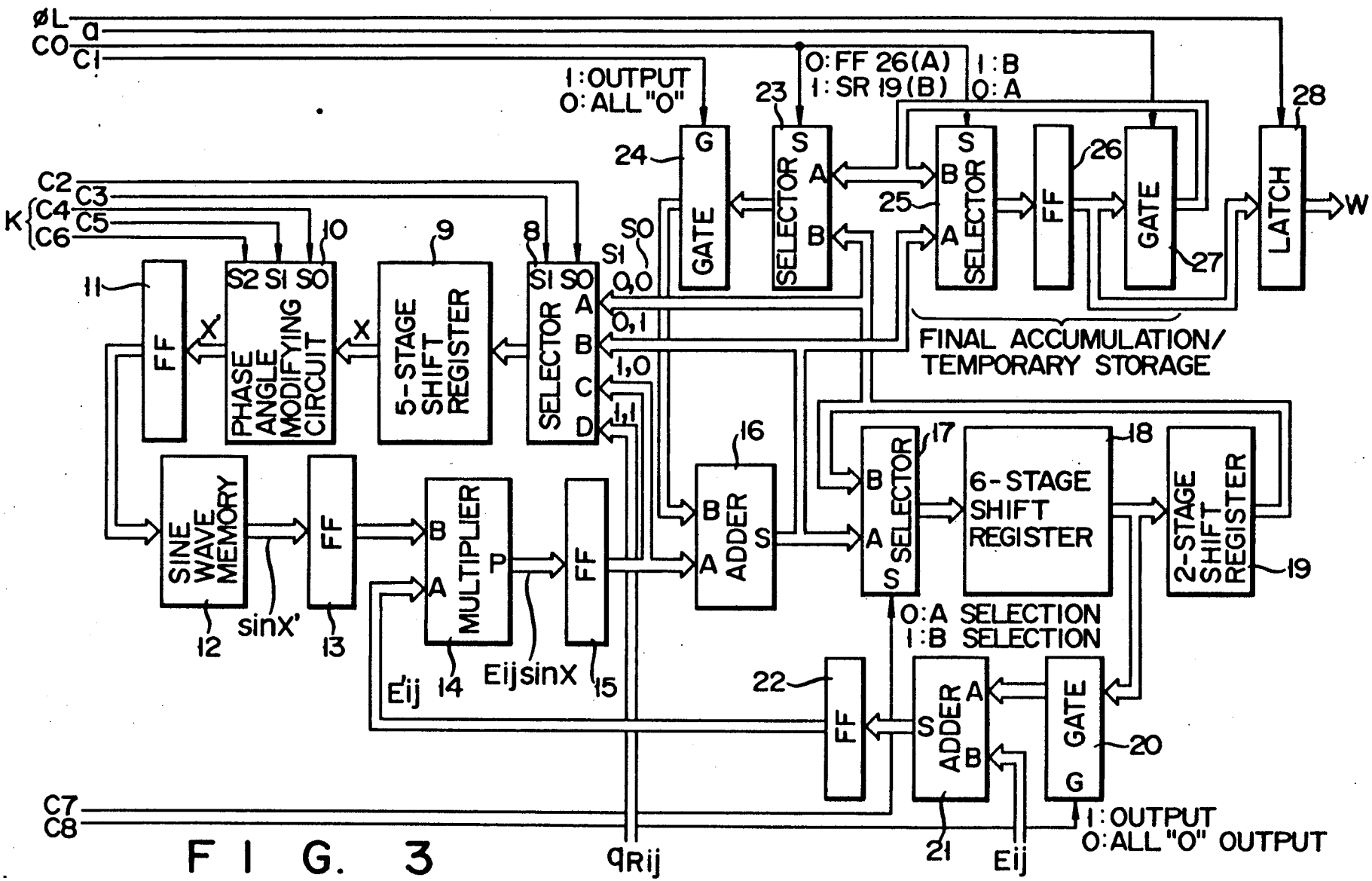
FIG. 3 is a block diagram of waveform generator 6 as the main part of the embodiment of the present invention.

FIG. 3 is a detailed block diagram of waveform generator 6. All FFs (flip-flops) and shift registers in FIG. 3 are operated in response to two-phase clocks $\phi$1 and $\phi$2 (not shown in FIG. 3). Selector 8 selects final phase angle data and is operated as follows:

| | |
|---|---|
| S1S0 = 00 → A | output from 2-stage shift register 19 |
| S1S0 = 01 → B | output from adder 16 |
| S1S0 = 10 → C | output E'ijsinX' from FF 15 |
| S1S0 = 11 → D (C2C3) | original phase angle data qRij |

5-stage shift register 9 delays an input signal by 5-bit time. Phase angle modifying circuit 10 switches a conversion coefficient between original phase angle data X and modified phase angle data X', so that the inclination of modified phase angle data X' changes stepwise in accordance with original phase angle data X. More specifically, FIGS. 4A to 4G show the modifying method of phase angle changing circuit 10. FIG. 4G shows the relationship between original phase angle data X and modified phase angle data X' for finally accessing sine wave memory 12. As can be apparent from FIG. 4G, in a function characterizing the relationship between these two data, the inclination, i.e., a multiplier to be multiplied with X, varies in accordance with the value of X. If the multipliers are given as $\alpha$ ($0\leqq X<M$, $N-M\leqq X<N$) and as $\beta$ ($M\leqq X<N-M$), $$\alpha=(N/4)/M$$

$$\beta=(N/4)/(N/2-M)$$

Therefore, $1/\alpha+1/\beta=2$. Note that N represents one period $2\pi$ of sine wave memory 12, and M represents a switching point of the multipliers. If $X=M$, $X'=N/4$ and the maximum value of the sine waves in sine wave memory 12 is accessed (see FIG. 6).

For example, if $\beta=\alpha/2^k$, $$\alpha=(2^k+1)/2$$

$$\beta=(1+2^{-k})/2$$

Therefore, multiplication for changing phases can be executed by a bit shift method.

Figure 4A:
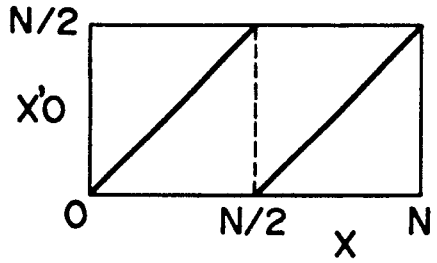
FIGS. 4A to 4G are graphs for explaining the function of a phase angle modifying circuit.
Figure 4B:
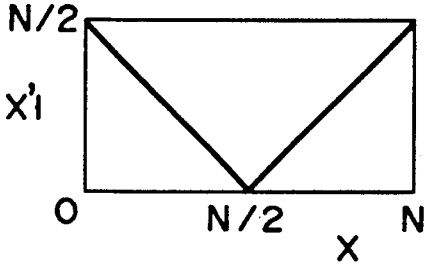
Figure 4C:
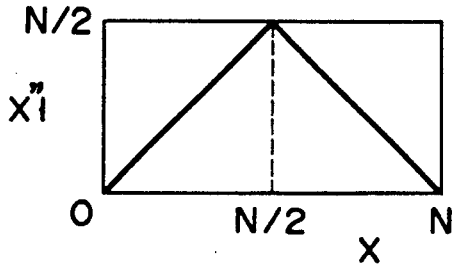
Figure 4D:
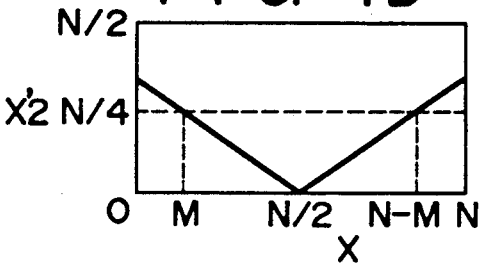
Figure 4E:
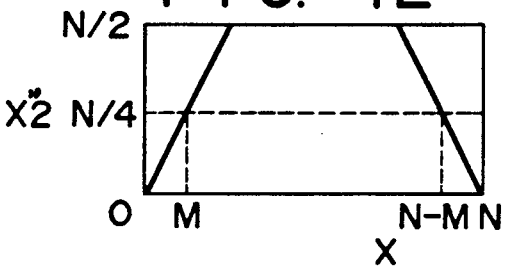
Figure 4F:
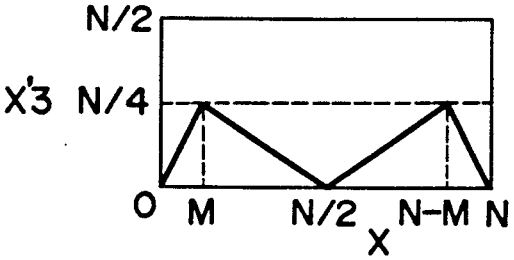
Figure 4G:
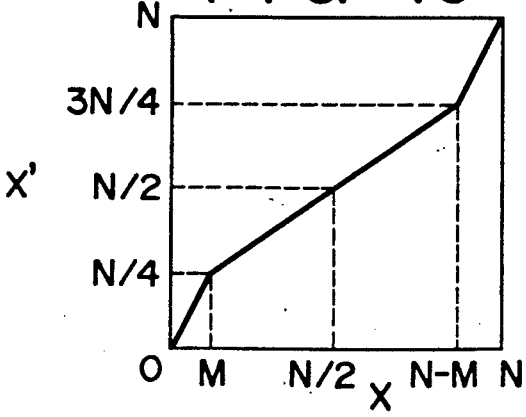

FIGS. 4A to 4G show the procedures for producing finally modified phase angle data X' from original phase angle data X. X0' in FIG. 4A is obtained by subtracting most significant bit $X_{MSB}$ from X; X1' and X1'' in FIGS. 4B and 4C are obtained by appropriately inverting X0', X2' in FIG. 4D is obtained by multiplying X1' with $\beta$, X2'' in FIG. 4E is obtained by multiplying X1'' with $\alpha$, and X3' in FIG. 4F is obtained by linking X2'' and X2' as follows:

$$X3' = \begin{cases} X2'' \ (X2' \geqq N/4) \\ X2' \ (X2' < N/4) \end{cases}$$

Finally modified phase angle data X' shown in FIG. 4G is obtained using X3' shown in FIG. 4F as follows:

$$X' = \begin{cases} X3' & (0 \leqq X < M) \\ N/2 - X3' & (M \leqq X < N/2) \\ X3' + N/2 & (N/2 \leqq X < N - M) \\ (N/2 - X3') + N/2 & (N - M \leqq X \leqq N) \end{cases}$$

Figure 5:
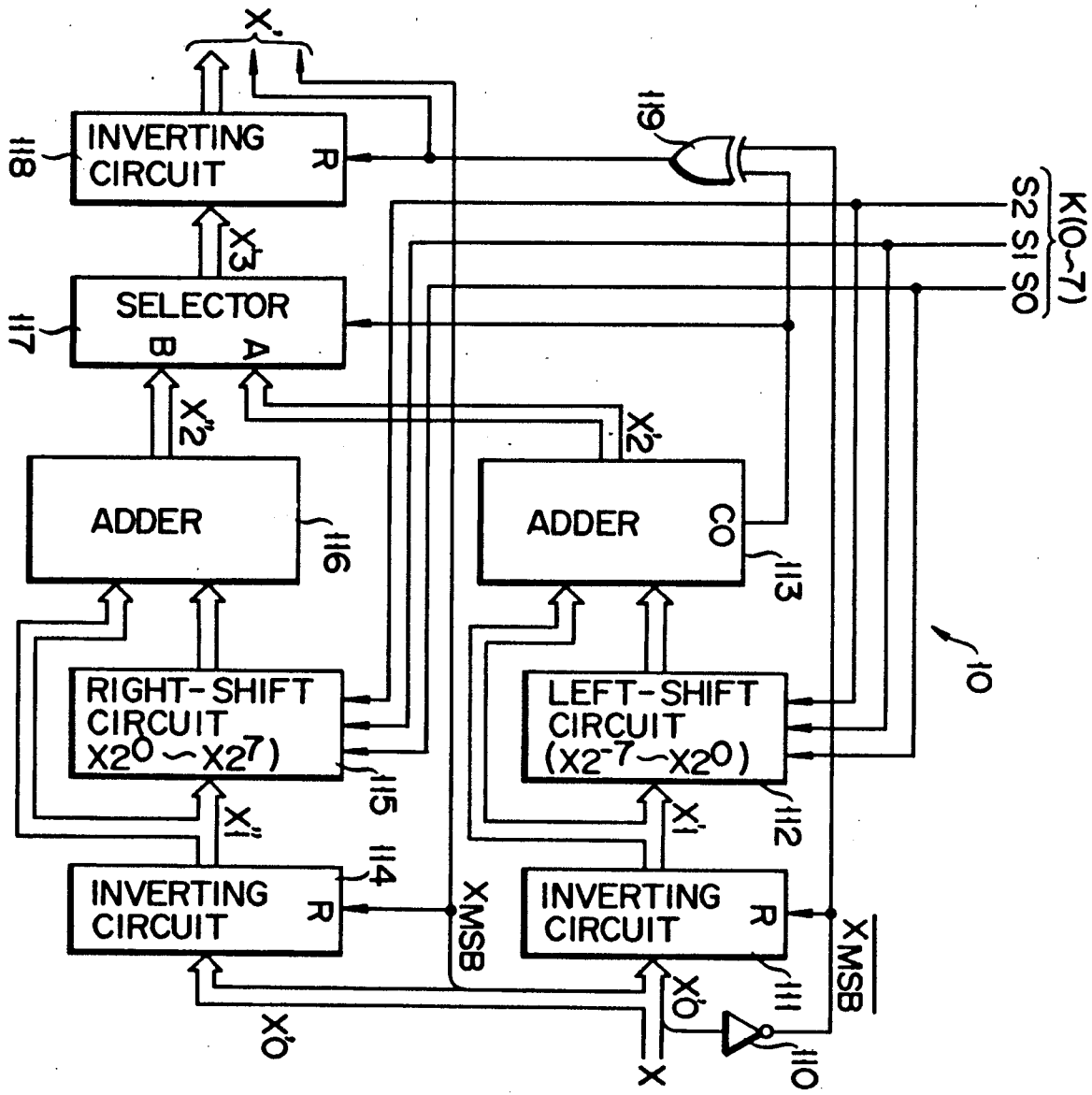
FIG. 5 is a block diagram showing the arrangement of a phase angle modifying circuit of the embodiment of the present invention.

FIG. 5 shows a circuit for executing the processing explained with reference to FIGS. 4A to 4G. Original phase angle data X supplied from 5-stage shift register 9 is inverted by inverting circuits 111 and 114 whose outputs are inverted when inverting control inputs R are set at "1" level in accordance with most significant bit $X_{MSB}$. More specifically, since inverting circuit 111 receives $\overline{X_{MSB}}$ through inverter 110, it is in the inverting mode if $X_{MSB}=0$, and is in noninverting mode if $X_{MSB}=1$. On the other hand, inverting circuit 114 is set in the noninverting mode if $X_{MSB}=0$, and is in the inverting mode if $X_{MSB}=1$. Therefore, the outputs from the inverting circuits 111 and 114 correspond to X1' and X1'' shown in FIGS. 4B and 4C, respectively. Inverting circuits 111 and 114 preferably output a complementary number of 2 in the inverting mode in terms of precision. Alternatively, an exclusive OR group (EX-OR group) for producing a complementary number of 1 can be adopted instead. Left-shift circuit 112 and adder 113 multiply X1' with above-mentioned multiplier $\beta$ in accordance with control inputs S0 to S2, i.e., C4 to C6 (binary data corresponding to k). The input to adder 113 is left-shifted (multiplied with 1/2), and adder 113 executes the following relation:

$$\begin{aligned} X2' &= \beta X1' \\ &= 2^{-1}(2^{-k}X1' + X1') \end{aligned}$$

(where k =0 to 7)

Similarly, right-shift circuit 115 and adder 116 multiply X1'' with above-mentioned multiplier $\alpha$, and execute:

$$\begin{aligned} X2'' &= \alpha X1'' \\ &= 2^{-1}(2^{k}X1'' + X1'') \end{aligned}$$

Selector 117 produces X3' shown in FIG. 4F, and selects one of outputs X2' and X2'' from adders 113 and 116. When adder 113 outputs carry out C0, i.e., only when X2'≧N/4 in FIG. 4D, selector 117 selects X2''; otherwise, it selects X2'.

Inverting circuit 118 is set in the inverting mode when inverting control input R is "1" in the same manner as in inverting circuits 111 and 114. Inverting circuit 118 inverts X3' in accordance with an output from EX-0R gate 119 receiving $\overline{X_{MSB}}$ and carry out C0, so that the polarity of the inclination of X3' shown in FIG. 4F becomes positive.

(a) If X =0 to M, since $X_{MSB}=0$ and C0=1, X3' is not inverted.
(b) If X =M to N/2, since $X_{MSB}=0$ and C0 =0, X3' is inverted.
(c) If X =N/2 to N - M, since $X_{MSB}=1$ and C0 =0, X3' is not inverted.
(d) If X =N - M to N, since $X_{MSB}=1$ and C0 =1, X3' is inverted.

Furthermore, when the output from inverting circuit 118 is added to the output from the EX-OR gate 119 and XMSB as upper bits, X' shown in FIG. 4G, i.e., modified phase angle data can be obtained.

Figure 6:
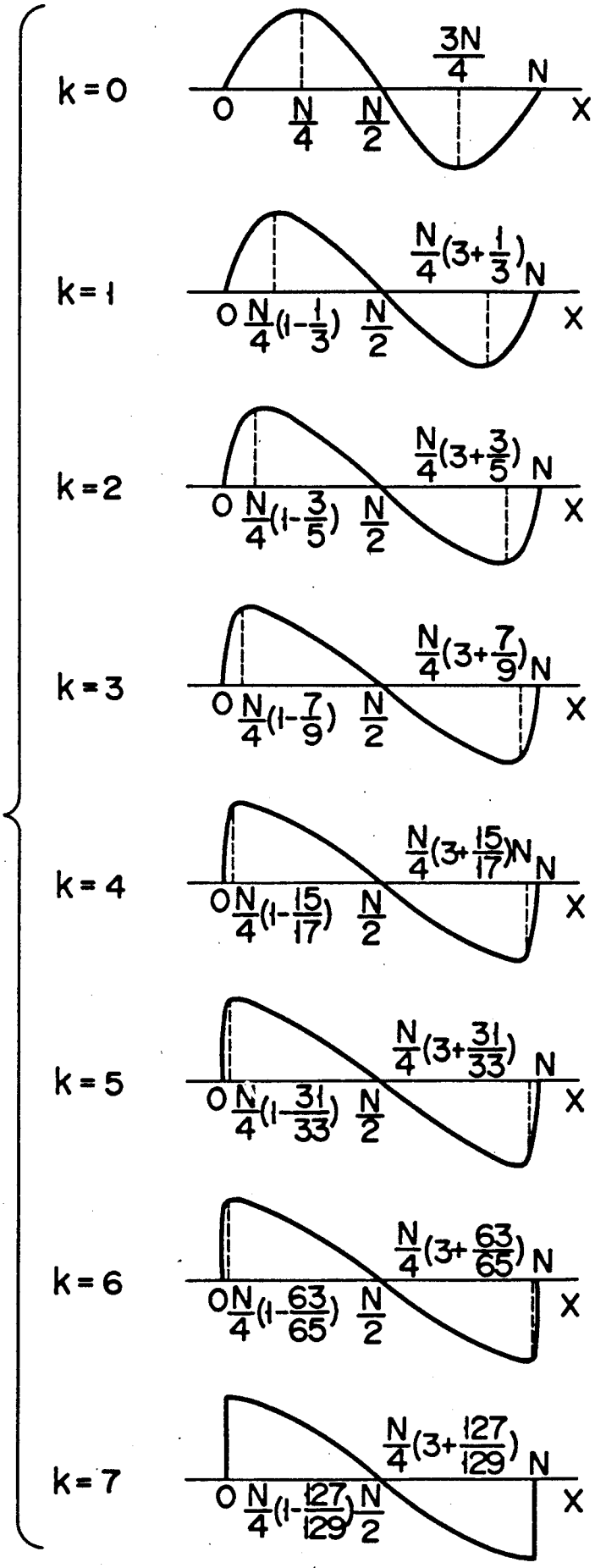
FIG. 6 is a waveform chart showing various waveforms generated in the embodiment of the present invention.
Figure 7:
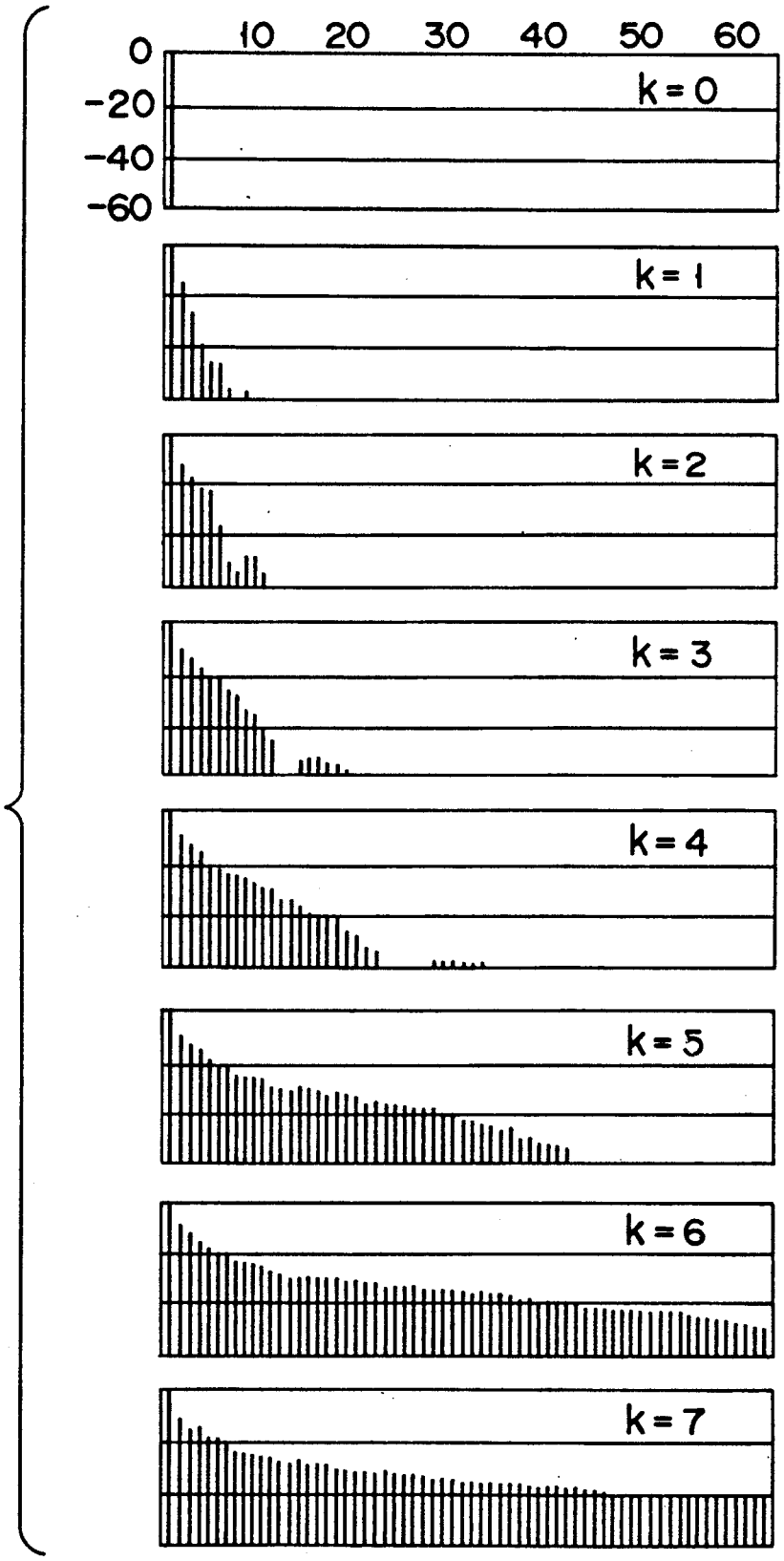
FIG. 7 is a spectrum chart showing spectra of various waveforms produced in the embodiment of the present invention.

FIGS. 6 and 7 show waveforms and their spectra generated when sine wave memory 12 is accessed by output X' from phase angle modifying circuit 10 with respect to various values of k. As the value of k increases 0 to 7, the spectrum gradually increases in amplitude in a sawtooth wave manner.

More specifically, circuit 10 of this embodiment produces output X' shown in FIG. 4G with respect to input X, and sine wave memory 12 is accessed by output X', thus obtaining a distorted waveform output shown in FIG. 6. Since the control input to phase angle modifying circuit 10 has a 3-bit configuration, waveforms distorted by eight-step depths (=k) can be obtained. More specifically, when the output from the phase angle modifying circuit 10 is used as an address of sine wave memory 12, this is equivalent to that the apparatus of this embodiment has memories for eight types of waveforms as shown in FIG. 6 (their spectra are shown in FIG. 7). Output sinX' from sine wave memory 12 is multiplied with modified envelope E'ij by multiplier 14 through FF 13. Output E'ijsinX' from multiplier 14 is input to selector 8 and adder 16 through FF 15. Adder 16 adds output E'ijsinX' from multiplier 14 and the output from gate 24, and its output is input to selectors 8, 17, and 25. Selector 17 switches whether or not the storage contents of 6-stage shift register 18 and 2-stage shift register 19 are changed. If S =0, selector 17 selects an A input (storage content is changed) and if S =1, a B input (storage content is held). The output from 6-stage shift register 18 is added to envelope Eij by adder 21 through gate 20 to produce changed envelope E'ij, which is input to multiplier 14. If control input G is "1", gate 20 allows input data to be output to adder 21, and if it is "0", outputs all "0" data. Thus, it can be selected whether or not the contents of shift registers 18 and 19 constituting a memory circuit, for example, preceding sine wave data for one module, is multiplied with waveform sinX' output from sine wave memory 12. Selector 23 selects one of the outputs from FF 26 or 2-stage shift register 19, and supplies the selected output to adder 16 through gate 24. Selector 23 performs selection as follows:

$GS=0^{*} \rightarrow All$ "0"

GS=10→output from FF 26

GS=11→output from 2-stage shift register 19

Selector 25, FF 26, and gate 27 store data obtained by accumulating all the output data during a unit sampling period, and the storage operation is performed by switching whether the content of FF 26 is held or changed by selector 25. Gate 27 sets preceding data to be all "0" at the beginning of the sampling period. Latch 28 latches the content of FF 26 at a timing corresponding to a sum of all the data during each sampling period, and outputs the latched data. As described above, when control signals C0 to C8 are appropriately switched, various waveform calculations are allowed.

The operation timings and control signals C0 to C8 will now be described. As can be understood from the above description, the functions of control signals C0 to C8 are as follows:

| | |
|---|---|
| C0, C1 | B input selection of adder 16 |
| C2, C3 | selection of final phase angle data X |
| C4, C5, C6 | designation of phase angle modifying degree |
| C7 | changing of storage data |
| C8 | whether or not waveform multiplication is performed |

Figure 8A:
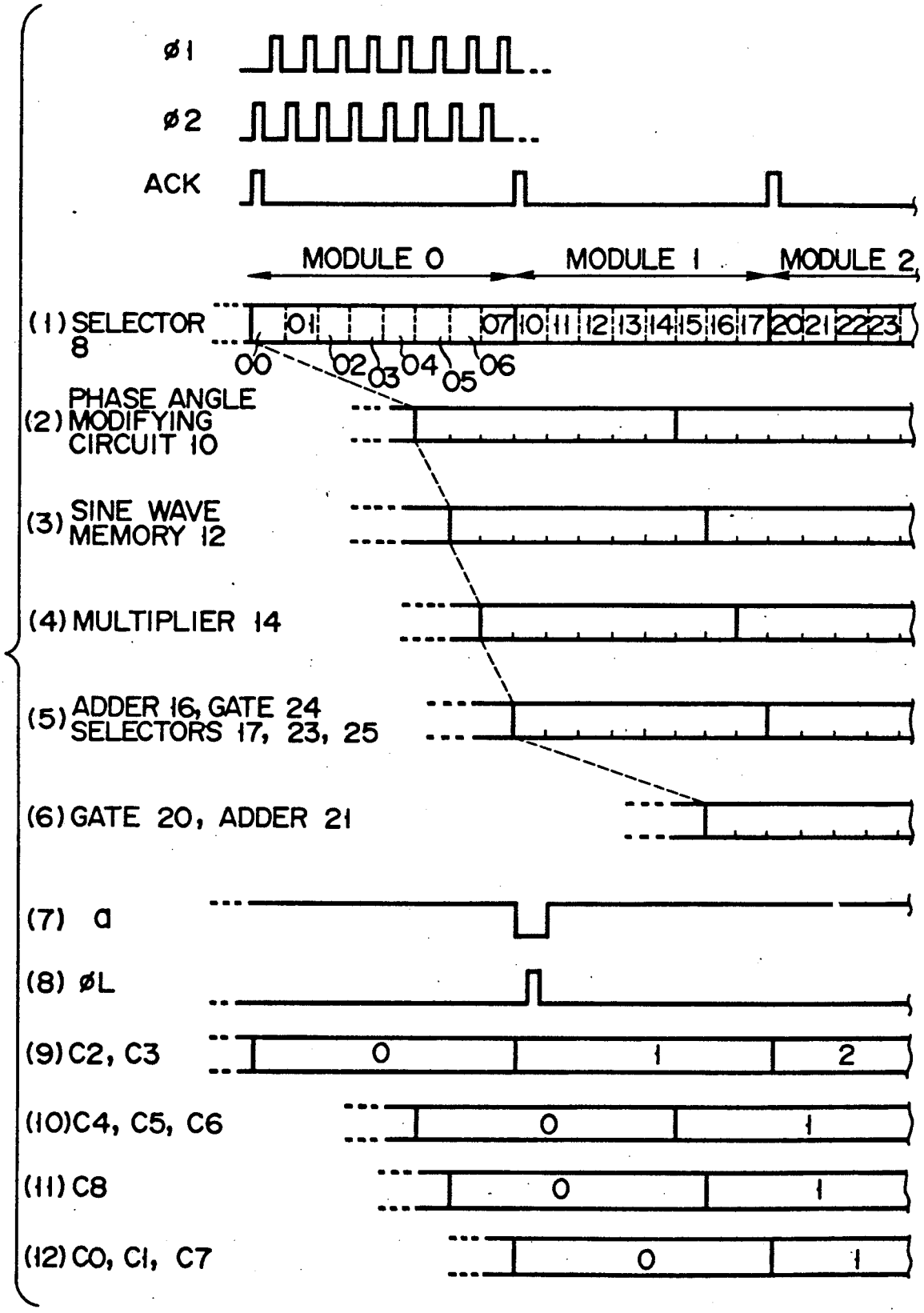
FIGS. 8A and 8B show, in combination, a timing chart for explaining the operation of the waveform generator.
Figure 8B:
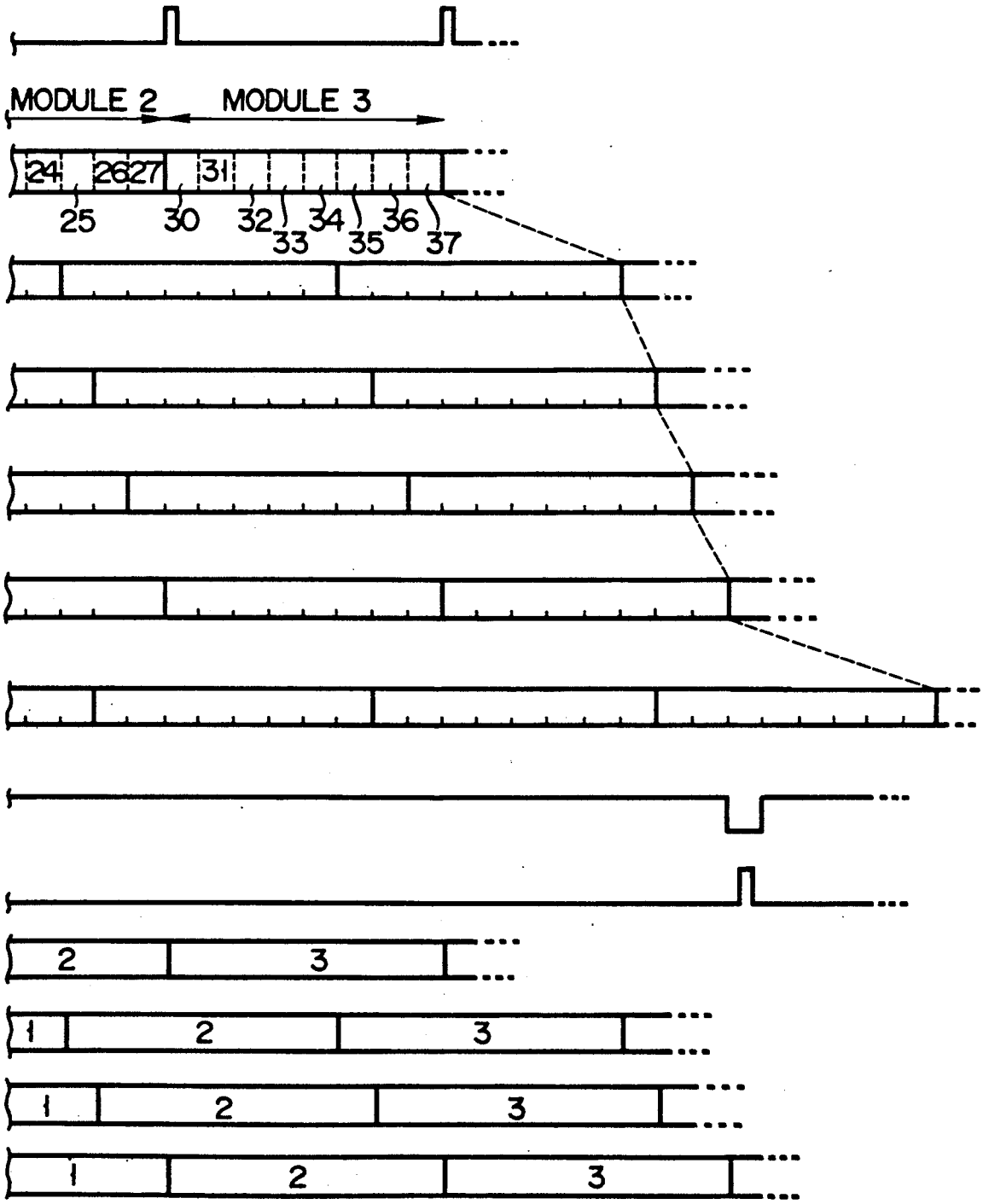

These signals C0 to C8 are appropriately generated for each module, so as to perform a desired waveform calculation. FIGS. 8A and 8B show the operation timings of the function blocks in FIG. 3 with reference to the operation start time of selector 8. Reference symbols $\phi 1$ and $\phi 2$ denote operation clocks. Clock $\phi 1$ is a read clock, and clock $\phi 2$ is an output clock. Reference symbol ACK denotes an address clock for reading out control signals C0 to C8. (1) to (6) in FIGS. 8A and 8B are operation timings of the respective blocks in FIG. 3 to represent the number of bits by which the operations of the respective blocks are delayed from the operation of selector 8. Control signals C0 to C8 and the respective blocks have the following correspondences:

selector 8 ⟷C2, C3
phase angle modifying circuit 10 ⟷C4, C5, C6
selector 17 ⟷C7
selector 23, 25 ⟷C0
gate 24 ⟷C1
gate 20 ⟷C8

Therefore, the timings of control signals C0 to C8 are as shown in (9) to (12) in FIGS. 8A and 8B. A data reset operation by gate 27 corresponds to a timing at which FF 26 outputs a sum of all the data and signal a is supplied to the gate 27, as shown in (7) in FIGS. 8A, 8B. Latch timing $\phi 0$ of latch 28 for final output need only be equal to a timing for fetching final data from selector 25, i.e., data in module 3 of channel 7, as shown in (8) in FIGS. 8A and 8B.

Figure 9:
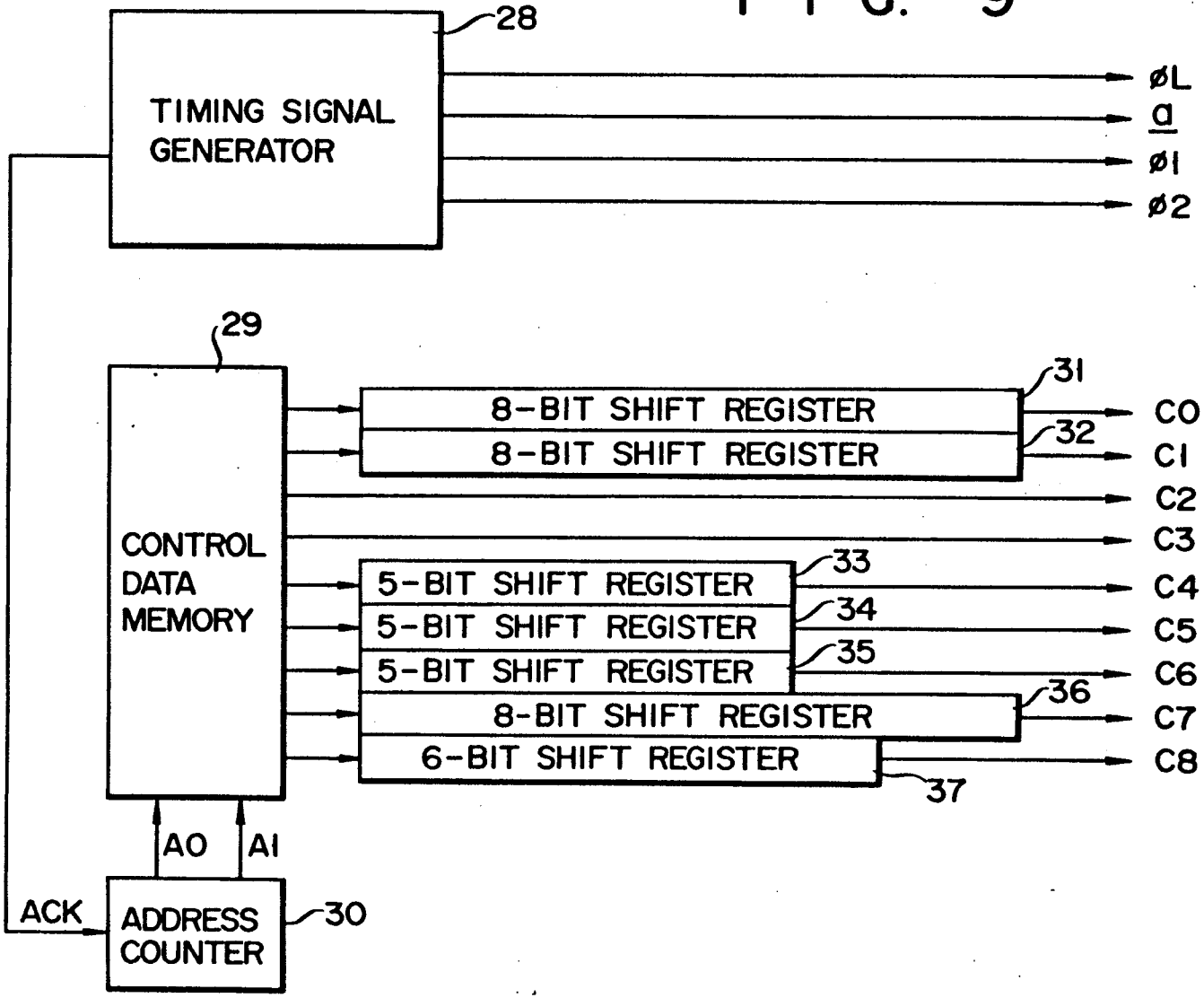
FIG. 9 is a block diagram of a control circuit.

FIG. 9 shows the arrangement of controller 5. Timing signal generator 28 generates reference clocks $\phi 1$ and $\phi 2$, timing signal a, latch timing signal $\phi L$, and address clock ACK for address counter 30. Address counter 30 receives address clock ACK, and generates addresses A0 and Al in synchronism with its leading edge. Control data memory 29 stores control data C0 to C8 in units of modules, and its content is read out in synchronism with the address clock. Shift registers 31 to 37 delay the timing of the readout control data, and generate control signals C0 to C8 as shown in (9) to (12) in FIGS. 8A, 8B. With these data, desired waveform calculations can be executed.

EXAMPLE 1 WHEN EijsinqRi1 IS ADDED TO FINAL OUTPUT

Table 1 shows combinations of control data C0 to C8 used in this case.

TABLE 1

| Module | C0 | C1 | C2 | C3 | C4 | C5 | C6 | C7 | C8 |
|---|---|---|---|---|---|---|---|---|---|
| i | 0 | 1 | 1 | 1 | 0 | 0 | 0 | * | 0 |

First, since C2 =1 and C3 =1, selector 8 selects original phase angle data =qRij. Phase angle data qRij is input to phase angle modifying circuit 10 at a timing delayed by 5 bits. However, since 5-bit delayed data C4, C5, and C6 are "0", a phase angle is not modified, and X'=X =qRij is output, so that sine wave memory 12 outputs data sinqRij. In gate 20, since 6-bit delayed data C8 is "0", adder 21 outputs data Eij, and multiplier 14 outputs data EijsinqRij. In selector 23 and gate 24, since 8-bit delayed data C0 and C1 are respectively C0 ="0" and C1 ="1", the output from FF 26 is input to a B input of adder 16 through gate 27, and the output from adder 16 is fetched by FF 26 through selector 25. As a result, the output from FF 26 is changed to data obtained by adding a current value to EijsinqRij. If i =j ="0", since the output from gate 27 is "0", FF 26 fetches EijsinqRij.

EXAMPLE 2 WHEN SINE WAVE DATA IN MODULE I IS USED AS PHASE ANGLE DATA IN NEXT MODULE I+1

Table 2 shows combinations of control data used when Y1 =Ei+1,j·sin(EijsinqRij) is obtained.

TABLE 2

| Module | C0 | C1 | C2 | C3 | C4 | C5 | C6 | C7 | C8 |
|---|---|---|---|---|---|---|---|---|---|
| i | 1 | * | 1 | 1 | 0 | 0 | 0 | * | 0 |
| i + 1 | 0 | 1 | 0 | 1 | 0 | 0 | 0 | * | 0 |

In the case of module i, since C2 ="1" and C3 ="1", selector 8 selects original phase angle data qRij. Phase angle data qRij is input to phase angle modifying circuit 10 at a timing delayed by 5 bits. However, since 5-bit delayed data C4, C5, and C6 are "0", X'=X =qRij is output, and sine wave memory 12 outputs data sinqRij. Since 6-bit delayed data C8 is "0" in gate 20, adder 21 outputs data Eij, and multiplier 14 outputs data EijsinqRij. Since 8-bit delayed data C0 is "1" in selector 25, FF 26 helds the preceding data.

In the case of module i+1, since C2 =0 and C3 =1, selector 8 selects output EijsinqRij from FF 15, i.e., sine wave data in module i. Although EijsinqRij is input to phase angle modifying circuit 10 at a timing delayed by 5-bits, since 5-bit delayed data C4, C5, and C6 are "0", X'=X =EijsinqRij the output from sine wave memory 12 becomes sin(EijsinqRij). In gate 20, since 6-bit delayed data C8 is "0", adder 21 outputs data Ei+1j, and multiplier 14 outputs data Ei+1jsin(EijsinqRij). In selector 23 and gate 24, since 8-bit delayed data C0 and C1 are respectively C0 ="0" and C1 ="1", the output from FF 26 is input to the B input of adder 16 through gate 27, and the output from adder 16 is fetched by FF 26 through selector 25. As a result, the content of FF 26 corresponds to a value obtained by adding a current value to Ei+1jsin(EijsinqRij). At this time, if the waveform produced in module i+1 is given as Y1, $$Y1 = Ei+1j\sin(EijsinqRij)$$

For the sake of simplicity, if Eij →Ei, Ei+1j →Ei+1, and qRij →ωit, the above equation is developed as follows:

$$Y1 = Ei + 1\sin(Ei\sin\omega it) \quad (1)$$

$$= Ei + 1 \sum_{n=-\infty}^{\infty} Jn(Ei)\sin n\omega it$$

where Jn(Z) is the Bessel function. Therefore, a large number of tone strings can be produced in accordance with envelope Ei.

EXAMPLE 3 WHEN SINE WAVES OBTAINED IN MODULES I AND I+1 ARE ADDED TO OBTAIN PHASE ANGLE DATA OF SINE WAVE IN MODULE I+2

Table 3 shows combinations of control data used when waveform Y2 =Ei+2jsin(EijsinqRij +Ei+1-jsinqRi+ij) is obtained.

TABLE 3

| Module | C0 | C1 | C2 | C3 | C4 | C5 | C6 | C7 | C8 |
|---|---|---|---|---|---|---|---|---|---|
| i | 1 | 0 | 1 | 1 | 0 | 0 | 0 | 0 | 0 |
| i + 1 | 1 | 1 | 1 | 1 | 0 | 0 | 0 | * | 0 |
| i + 2 | 0 | 1 | 1 | 0 | 0 | 0 | 0 | * | 0 |

In the case of module i, since C2 ="1" and C3 ="1", selector 8 selects original phase angle data qRij. Original phase angle data qRij is input to phase angle modifying circuit 10 at a timing delayed by 5 bits. However, since 5-bit delayed data C4, C5, and C6 are "0", X'=X =qRij is output, and sine wave memory 12 outputs data sinqRij. In gate 20, since 6-bit delayed data C8 is "0", adder 21 outputs data Eij, and multiplier 14 outputs data EijsinqRij. In gate 24, since 8-bi- delayed data C1 is "0", "0" is input to the B input of adder 16, and thus, adder 16 outputs data EijsinqRij. Since 8-bit delayed data C7 is "0", selector 17 causes output EijsinqRij from adder 16 to be fetched by 6-stage shift register 18. In selector 25, since 8-bit delayed data C0 is "1", the content of FF 26 is held.

In the case of module i+1, since C2 ="1" and C3 ="1", selector 8 selects original phase angle data qRi+1j. Phase angle data qRi+1j is input to phase angle modifying circuit 10 at a timing delayed by 5 bits. However, since 5-bit delayed data C4, C5, and C6 are "0", X'=X =qRi+1j is output, and sine wave memory 12 outputs data sinqRi+1j. In gate 20, since 6-bit delayed data C8 is "0", adder 21 outputs data Ei+1j, and multiplier 14 outputs data Ei+1jsinqRi+1j. In selector 23 and gate 24, since 8-bit delayed data C0 and C1 are respectively C0 ="1" and C1 ="1", output EijsinqRij from 2-stage shift register 19, i.e., sine wave data obtained in the preceding module is supplied to the B input of adder 16. Therefore, adder 16 outputs data EijsinqRij +Ei+1-jsinqRi+1j. In selector 25, since 8-bit delayed data C0 is "1", the content of FF 26 is held.

In the case of module i+2, since C2 =1 and C3 =0, selector 8 selects output EijsinqRij +Ei+1jsinqRi+1j from adder 16 as phase angle data. Phase angle data EijsinqRij +Ei+1jsinqRi+1j is input to phase angle modifying circuit 10 at a timing delayed by 5 bits. However, since 5-bit delayed data C4, C5, and C6 are "0", X'=X =Eijs1nqRij +Ei+1jsinqRi+1j is output, and sine wave memory 12 outputs data sin(EijsinqRij +Ei+1jsinqRi+1j). In gate 20, since 6-bit delayed data C8 is "0", adder 21 outputs data Ei+2j, and multiplier 14 outputs data Ei+2jsin(EijsinqRij +Ei+1jsinqRi+1j). In selector 23 and gate 24, since 8-bit delayed data C0 and C1 are respectively C0 ="0" and C1 ="1", the output from FF 26 is input to the B input of adder 16 through gate 27, and the output from adder 16 is fetched by FF 26 through selector 25. As a result, the content of FF 26 becomes a value obtained by adding a current value to Ei+2jsin(EijsinqRij +Ei+1jsinqRi+1j). At this time, if the waveform produced in module i+2 is given as Y2, $$Y2=Ei+2jsin(EijsinqRij+Ei+1jsinqRi+1j)$$

For the sake of simplicity, if Eij →Ei, Ei+1j →Ei+1, Ei+2j →Ei+2, qRij →ωit, and qRi+1j →ωi+1t, the above equation is developed as follows:

$$\begin{aligned} Y2 &= Ei + 2\sin(Ei\sin\omega it + Ei + 1\sin\omega i + 1t) \\ &= Ei + 2\sum_m\sum_n Jm(Ei)Jn(Ei+1)\sin(m\omega it + n\omega i + 1t) \end{aligned} \quad (2)$$

A large number of harmonic overtone strings can be generated in accordance with ωi, ωi+1, Ei, and Ei+1.

EXAMPLE 4 WHEN SINE WAVE IN MODULE I AND SINE WAVE IN MODULE I+1 ARE MULTIPLIED

Table 4 combinations of control data used when waveform Y3 =(Ei+1j +EijsinqRij)sinqRi+1j is obtained.

TABLE 4

| Module | C0 | C1 | C2 | C3 | C4 | C5 | C6 | C7 | C8 |
|---|---|---|---|---|---|---|---|---|---|
| i | 1 | 0 | 1 | 1 | 0 | 0 | 0 | 0 | 0 |
| i + 1 | 0 | 1 | 1 | 1 | 0 | 0 | 0 | * | 1 |

In the case of module i, since C2 ="1" and C3 ="1", selector 8 selects original phase angle data qRij. Phase angle data qRij is input to phase angle modifying circuit 10 at a timing delayed by 5 bits. However, since 5-bit delayed data C4, C5, and C6 are "0", X'=X =qRij is output, and sine wave memory 12 outputs data sinqRij. In gate 20, since 6-bit delayed data C8 is "0", adder 21 outputs data Eij, and multiplier 14 outputs data EijsinqRij. In gate 24, since 8-bit delayed data C1 is "0", "0" is input to the B input of adder 16, and adder 16 outputs data EijsinqRij. Since 8-bit delayed data C7 is "0", selector 17 causes output EijsinqRij to be fetched by 6-stage shift register 18. In selector 25, since 8-bit delayed data C0 is "1", the content of FF 26 is held.

In the case of module i+1, since C2 ="1" and C3 ="1", selector 8 selects original phase angle data qRi+1j. Phase angle data qRi+1j is input to phase angle modifying circuit 10 at a timing delayed by 5 bits. However, since 5-bit delayed data C4, C5, and C6 are "0", X'=X =qRij is output, and sine wave memory 12 outputs data sinqRi+1j. In gate 20, since 6-bit delayed data C8 is "1", adder 21 outputs data Ei+1j +EijsinqRij. Therefore, multiplier 14 outputs data (Ei+1j +EijsinqRij)sinqRi+1j. In selector 23 and gate 24, since 8-bit delayed data C0 and C1 are respectively C0 ="1" and C1 ="1", the output from FF 26 is input to the B input of adder 16 through gate 27, and is added to (Ei+1j +EijsinqRij)sinqRi+1j. Thereafter, the sum data is fetched by FF 26 through selector 25. At this time, if the waveform produced in module i+1 is given as Y3, $$Y3=(Ei+1j+EijsinqRij)sinqRi+1j$$

For the sake of simplicity, if Eij →Ei, Ei+1j →Ei+1, qRij →ωit, and qRi+1j →ωi+1t, $$
\begin{aligned}
Y3 &= (Ei + 1 + Ei\sin\omega it)\sin\omega i + 1t \qquad (3)\\
&= Ei + 1\sin\omega i + 1t + Ei\sin\omega it\sin\omega i + 1t\\
&= Ei + 1\sin\omega i + 1t + Ei/2\{\cos(\omega i + 1 - \omega i)t - \\
&\quad \cos(\omega i + 1 + \omega i)t\}
\end{aligned}
$$

Therefore, this represents a form of amplitude modulation, and a side wave is produced.

As described above, four ways of waveform generation have been described. In addition to these, various waveforms can be produced by the same control as above, and they can still be combined to obtain a large number of waveform variations. In the above description, control inputs C4, C5, and C6 to the phase angle modifying circuit are "0". However, if they are set for each module, a calculation based on a waveform other than the sine wave can be made. In this case, if sine wave sinωit in module i in equation (1) is replaced with $$\sum_{n=1}^{N} an\sin n\omega it,$$

$$Y1 = Ei + 1\sin\left(Ei\sum_{n=1}^{N}\sin n\omega it\right)$$

If sine wave sin(Eisinnωit) in module 1+1 in equation (1) is replaced with $$\sum_{n=1}^{N} an\sin n\omega it,$$

$$
\begin{aligned}
Y1 &= Ei + 1\sum_{m=1}^{N} am\sin(mEi\sin wit)\\
&= Ei + 1\sum_{m=1}^{N} am\sum_{n} Jn(mEi)\sin\omega it
\end{aligned}
$$

Therefore, the resultant waveform includes a large number of harmonic overtone components.

In the above embodiment, waveform variations can be produced by simple processing, such as processing for selecting phase angle data to be input to the sine wave memory, processing for appropriately modifying the selected phase, and the like. If amplitude modulation is selectively added, further waveform variation can be obtained.

The present invention is not limited to the above embodiment, and various changes and modifications may be made. For example, in the above embodiment, multiplier 14 performs not only a multiplication of produced waveforms (amplitude modulation) but also a multiplication of the produced waveform with envelope data, i.e., application of the envelope, thus decreasing the number of circuit components. However, if necessary, the application of the envelope can be executed by analog circuit means.

Alternatively, a special-purpose multiplier can be used for the envelope application. Similarly, in the above embodiment, adder 16 is used not only for adding a waveform currently produced through sine wave memory 12 and an accumulated waveform from FF 26 but also for adding a currently produced waveform to a previously produced waveform from 2-stage shift register 19. Another adder can be used if necessary.

The above arrangement has a polyphonic arrangement. The present invention can also be applied to a monophonic arrangement.

Although the apparatus of the present invention described above has a simple arrangement in that a waveform generator operated in a time-divisional manner selects data used for next waveform generation from preceding waveforms in the same sampling period, various waveforms can be produced.

Figure 10:
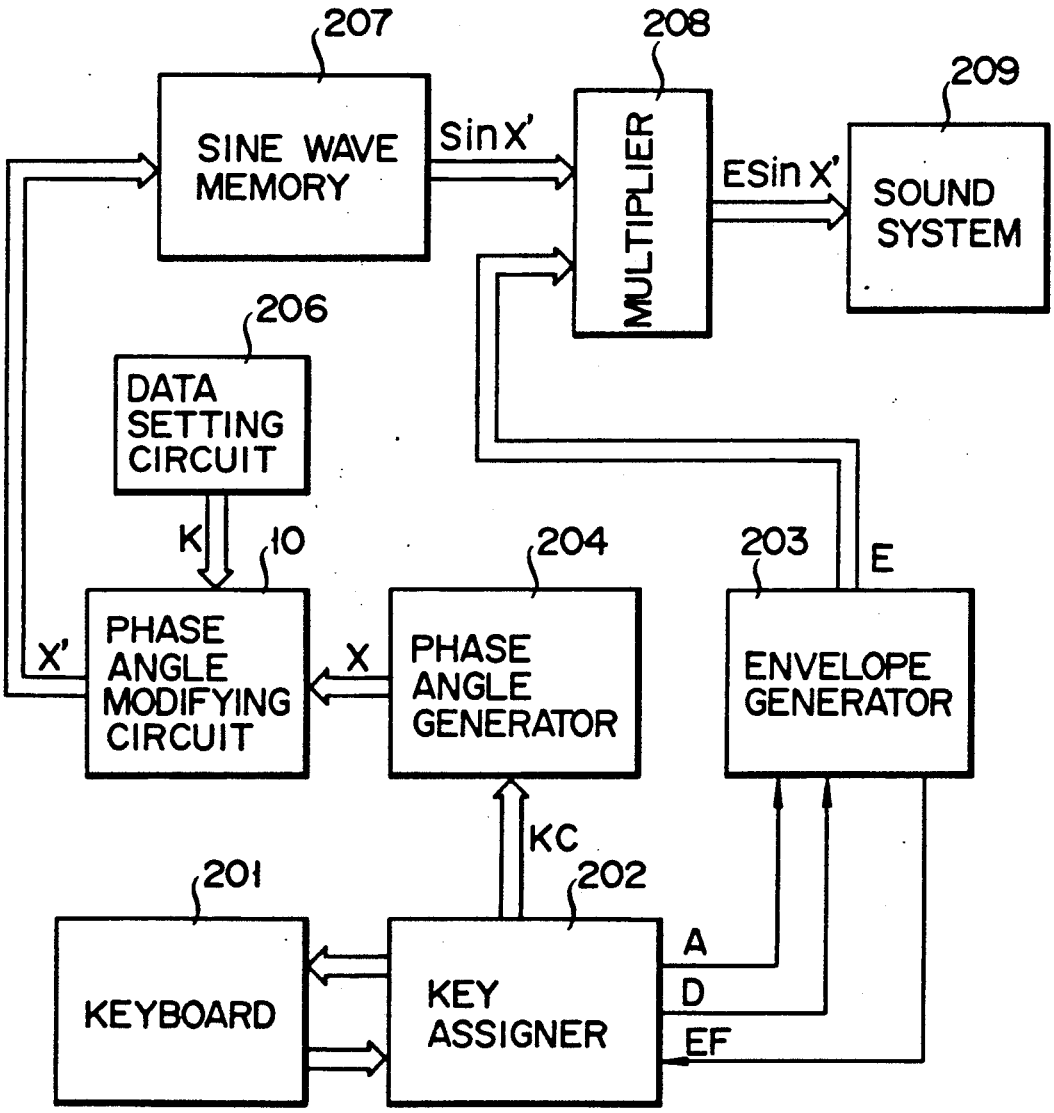
FIG. 10 is a block diagram of another electronic musical instrument using a phase angle modifying circuit shown in FIG. 5.

The waveform generator for an electronic musical instrument using phase angle modifying circuit 10 shown in FIG. 5 can also be arranged as shown in FIG. 10.

More specifically, keyboard 201 comprises switches for detecting ON/OFF operations of keys which are arranged in a matrix. Keyboard 201 is monitored by the scanning operation of key assigner 202. If a new key-on operation is detected, key assigner 202 generates key code KC and attack start signal A corresponding to the depressed key. In response to attack start signal A, envelope generator 203 begins to generate predetermined envelope waveform E. On the other hand, phase angle generator 204 generates a frequency data corresponding to key code KC supplied from assigner 202, and accumulates it to generate phase angle data X which changes at a constant rate. Phase angle modifying circuit 10 has the same arrangement as in FIG. 5, and modifies the value of phase angle data based on control data k from data setting circuit 206, thereby producing modified phase angle data X'. Modified phase angle data X' serves as a final address signal for sine wave memory 207 so as to cause it to produce corresponding sine waveform sinX'. Sine waveform is multiplied with envelope E by multiplier 208 to obtain musical tone waveform EsinX'. Sound system 209 D/A converts musical tone waveform EsinX' as digital data, and amplifies it to generate a sound.

Thereafter, when the depressed key is released, key assigner 202 generates decay start signal D to set the envelope in a released state. Upon completion of the released state, envelope generator 203 generates envelope end signal EF, and key assigner 202 is set in a tone generation end state.

According to the embodiment shown in FIG. 10, tone colors unique to rubbed string instruments can be easily generated. When value k of control data is changed over time, a musical tone whose tone color delicately changes can be produced. If a plurality of musical tone generators of this embodiment are provided and are driven while their frequencies and the degrees of phase modifying are set to be slightly different from each other (a time-divisional technique is also available), deep rich sounds can be produced.

The present invention is not limited to the embodiment shown in FIG. 10, and various other changes and modifications may be made. For example, in the above embodiment, the sine wave for one period stored in a waveform memory is accessed. However, the above-mentioned waveform can be produced from the sine wave for a half or quarter of the period by a simple modification. In the circuit shown in FIG. 5, two different coefficients are used. However, more coefficients can be switched to produce modified phase angle data. In the above embodiment, the switching operation of the coefficients is performed at a position at which the modified phase angle data indicates the maximum or minimum value of the waveform. However, the coefficients can be switched at other positions.

According to the present invention, control data is used as bit-shift signals in different directions to select a bit-shift direction adopted as an output or to change an inclination characteristic of modified phase angle data, resulting in a simple arrangement. In addition, a waveform whose spectrum gradually changes can be produced.

What is claimed is:

1. A waveform generator for an electronic musical instrument, comprising:

control means for controlling a waveform generation on a time division basis;

waveform generating means controlled by said control means for time-divisionally generating a plurality of waveform signals in a unit sampling period, said unit sampling period being divided into a plurality of module periods, and each of the module periods being divided into a plurality of channel periods; and selective operating means coupled to said waveform generating means for supplying said waveform generating means with at least one of a waveform signal and a sum of waveform signals already generated in preceding module periods in the same sampling period as data for a waveform signal to be generated in a next module period; and said waveform generating means including:

waveform memory means for storing a predetermined waveform;

address signal generating means for producing a normal address signal which changes at a substantially uniform rate corresponding to a selected frequency;

controllable modifying means coupled said waveform memory means and to said control means for selectively changing an input signal to form a modified signal as a result of variably performing a modifying operation of said controllable modifying means, said modified signal having an amplitude changing rate different from that of the input signal; and selecting means for selectively supplying one of (i) the normal address signal generated by said address signal generating means and (ii) the waveform signal or the sum of waveform signals delivered from said selective operation means as said input signal to said controllable modifying means, and said modified signal produced by said controllable modifying means being supplied to said waveform memory means as an address signal.

2. The waveform generator according to claim 1, wherein said waveform memory means includes a waveform memory for storing a sine waveform signal.

3. The waveform generator according to claim 1, wherein said waveform generating means further includes multiplying means for multiplying the waveform signals generated in the preceding module periods of the same sampling period or the sum of the waveform signals, with a waveform signal generated in a current module period.

4. The waveform generator according to claim 1, wherein said waveform generating means further includes multiplying means for multiplying envelope data with the waveform signal.

5. The waveform generator according to claim 1, wherein said selecting means includes data inputs, and wherein said waveform generating means further includes:

temporary storage means for storing a waveform signal of one module period obtained through said waveform memory means to delay said waveform signal by a time corresponding to a selected number in units of module periods; and linking means for linking the output from said temporary storage means to one of said data inputs of said selecting means.

6. A waveform generator for an electronic musical instrument, comprising:

phase angle generating means for generating phase angle data which changes at a frequency corresponding to a musical performance;

data setting means for generating control data designating a level of modifying said phase angle data generated by said phase angle generating means;

phase angle modifying means for modifying said phase angle data in accordance with said control data, and for outputting modified phase angle data; and a musical tone memory means for outputting a waveform, and whose address is designated by the output from said phase angle modifying means;

said phase angle modifying means including:

shift means for bit-shifting said phase angle data in different directions, the level of bit-shifting being a function of said control data; and bit-shifting direction selecting means for switching the direction of bit-shifting to define an inclination of the modified phase angle data as an output from said phase angle modifying means at a tinging during one cycle of the waveform.

7. A waveform generator for an electronic musical instrument, comprising:

phase angle generating means for generating phase angle data which changes at a frequency corresponding to a musical performance;

control data generating means for generating control data designating a level of modifying the phase angle data generated by said phase angle generating means;

phase angle modifying means for modifying said phase angle data in accordance with said control data, and for outputting modified phase angle data; and waveform memory means for outputting a waveform, and whose address is designated by the output from said phase angle modifying means;

said phase angle modifying means including bit-shift means for changing an inclination characteristic of said modified phase angle data as a function of said control data, said bit-shift means receiving said phase angle data, such that at least one of a bit-shift amount and a shift direction of said phase angle data is determined by said control data, and at least one of the bit-shift amount and the shift direction is switched during one cycle of the waveform;

said waveform memory means including means for storing at least of one a sine wave and a cosine wave as the waveform;

the control data generated by said control data generating means controlling said phase angle modifying means such that an inclination of the modified phase angle data with respect to the phase angle data is switched at least twice during one cycle of the waveform; and said control data determining a time elapsing from an origin (O) to a peak value (N/4, 3N/4), when at least one of the sine wave and the cosine wave is read out from said waveform memory means.

8. A generator according to claim 7, wherein:

said phase angle modifying means includes first and second inverting means for switching, in accordance with an inverted most significant bit ($\overline{X_{MSB}}$) and the most significant bit ($\overline{X_{MSB}}$) itself, inversion or non-inversion of remaining bits excluding said most significant bit;

said bit-shift means includes first and second bit shifting means for receiving outputs from said first and second inverting means and said control data, and includes first and second bit-shifting means for bit-shifting said outputs in opposite directions by an amount in accordance with a value of said control data;

said phase angle modifying means further includes first adding means for adding the output from said first inverting means and the output from said first bit-shifting means, second adding means for adding the output from said second inverting means and the output from said second bit-shifting means, selecting means for selectively switching an output from said first adding means and an output from said second adding means during one cycle of the waveform; and further comprising means for obtaining said modified phase angle data in accordance with an output from said selecting means.

9. A waveform generator for an electronic musical instrument, comprising:

control means for controlling a waveform generation on a time division basis;

waveform generating means controlled by said control means for time-divisionally generating a plurality of waveform signals in a unit sampling period, said unit sampling period being divided into a plurality of module periods, and each of the module periods being divided into a plurality of channel periods; and selective operation means coupled to said waveform generating means for supplying said waveform generating means with at least one of a waveform signal and a sum of waveform signals already generated in preceding module periods in the same sampling period as data for a waveform signal to be generated in a next module period; and said waveform generating means including:

various waveform signal generating means for generating various types of waveform signals, the types of which are selected by an input signal (C4~C6);

address signal generating means for generating a normal address signal which changes at a substantially uniform rate corresponding to a selected frequency; and selecting means for selectively supplying at least one of (i) the normal address signal generated by said address signal generating means and (ii) the waveform signal or the sum of the waveform signals delivered from said selective operation means as an address signal of the various waveform signal generating means.

10. The waveform generator according to claim 9, wherein said various waveform signal generating means includes waveform memory means for storing a sine waveform signal.

11. The waveform generator according to claim 9, wherein said waveform generating means further includes multiplying means for multiplying the waveform signals generated in the preceding module periods of the same sampling period or the sum of the waveform signals with a waveform signal generated in a current module period.

12. The waveform generator according to claim 9, wherein said waveform generating means further includes multiplying means for multiplying envelope data with the waveform signal.

13. The waveform generator according to claim 9, wherein said selecting means includes data inputs, and wherein said waveform generating means further includes:

temporary storage means for storing a waveform signal of one module period obtained through said various waveform signal generating means for delaying said waveform signal by a time corresponding to a selected number in units of module periods; and linking means for linking the output from said temporary storage means to one of said data inputs of said selecting means.

14. A waveform generator for an electronic musical instrument, comprising:

waveform generating means for generating a plurality of waveform signals on a time-divisional basis for a unit sampling period, said unit sampling period being divided into a plurality of module periods;

address signal generating means for generating a normal address signal which changes at a substantially uniform rate corresponding to a selected frequency;

supplying means coupled to said waveform generating means and to said address signal generating means for supplying said waveform generating means with one of (i) the normal address signal output from said address signal generating means, (ii) a waveform signal, and (iii) a sum of waveform signals already generated in preceding module periods in the same sampling period as address data for a waveform signal to be generated in a next module period;

a source of a selection input signal; and said waveform generating means including a various waveform signal generating means for generating various type waveform signals, the types of which are selected by the selection input signal, and said various waveform signal generating means being addressed by the signal selectively supplied from said supplying means.

15. The waveform generating according to claim 14 wherein said various waveform signal generating means includes:

controllable modifying means for selectively changing an address signal supplied from said supplying means to form a modified address signal, said modified address signal having an amplitude changing rate different from that of the address signal supplied from said supplying means and being controlled by the selection input signal; and waveform memory means for storing a sine waveform signal which is addressed by the modified address signal obtained from said controllable modifying means.

16. A waveform generator for an electronic musical instrument, comprising:

waveform generating means for generating a plurality of waveform signals on a time-divisional basis for a unit sampling period, said unit sampling period being divided into a plurality of module periods; and supplying means coupled to said waveform generating means for supplying said waveform generating means with at least one of a waveform signal and a sum of waveform signals already generated in preceding module periods in the same sampling period as data for a waveform signal to be generated in a next module period; and said waveform generating means including:

various waveform signal generating means for engaging various types of waveform signals, the types of which are selected by an input signal;

address signal generating means for generating a normal address signal which changes at a substantially uniform rate corresponding to a selected frequency; and selecting means for selectively supplying one of (i) the normal address signal generated by the address signal generating means and (ii) the waveform signal or the sum of waveform signals delivered from said supplying means as an address signal of said various waveform signal generating means.

17. The waveform generator according to claim 16, wherein said various waveform signal generating means includes waveform memory means for storing a sine waveform signal.

18. The waveform generator according to claim 16, wherein said waveform generating means further includes multiplying means for multiplying the waveform signals generated in the preceding module periods of the same sampling period or the sum of waveform signals, with a waveform signal generated in a current module period.

19. The waveform generator according to claim 16, wherein said waveform generating means further includes multiplying means for multiplying envelope data with the waveform signal.

20. The waveform generator according to claim 16, wherein said selecting means includes data inputs, and wherein said waveform generating means further includes:

temporary storage means for storing a waveform signal of one module period obtained through said various waveform signal generating means for delaying said waveform signal by a time corresponding to a selected number in units of module periods; and linking means for linking the output from said temporary storage means to one of said data inputs of said selecting means.

21. A method of generating a waveform for an electronic musical instrument, comprising:

controlling generation of a waveform on a time division basis;

time-divisionally generating, in a waveform generating means, a plurality of waveform signals in an unit sampling period, said unit sampling period being divided into a plurality of module periods, and each of the module periods being divided into a plurality of channel periods; and supplying said waveform generating means with at least one of a waveform signal and a sum of waveform signals already generated in preceding module periods in the same sampling period as data for a waveform signal to be generated in a next module period; and said step of time-divisionally generating said plurality of waveform signals including:

storing a predetermined waveform in a waveform memory means;

producing a normal address signal which changes at a substantially uniform rate corresponding to a selected frequency;

selectively changing an input signal to form a modified signal, said modified signal having an amplitude changing rate different from that of the input signal; and selectively supplying one of (i) said normal address signal and (ii) said waveform signal or said sum of waveform signals as said input signal which is selectively changed to form said modified signal, and supplying said modified signal to said waveform memory means as an address signal.

22. The method according to claim 21, wherein said step of storing said predetermined waveform comprises storing a sine waveform signal.

23. The method according to claim 21, wherein said step of time-divisionally generating said plurality of waveform signals further includes multiplying the waveform signals generated in the preceding module periods of the same sampling period or said sum of the waveform signals, with a waveform signal generated in a current module period.

24. The waveform generator according to claim 21, wherein said step of time-divisionally generating said plurality of waveform signals further includes multiplying envelope data with the waveform signal.

25. The method according to claim 21, wherein said step of time-divisionally generating said plurality of waveform signals further includes:

storing, in a temporary storage means, a waveform signal of one module period obtained through said waveform memory means, and delaying said waveform signal by a time corresponding to a selected number in units of module periods.

26. A method of generating a waveform for an electronic musical instrument, comprising:

controlling generation of a waveform on a time division basis;

time-divisionally generating, in a waveform generating means, a plurality of waveform signals in an unit sampling period, said unit sampling period being divided into a plurality of module periods, and each of the module periods being divided into a plurality of channel periods; and supplying said waveform generating means with at least one of a waveform signal and a sum of waveform signals already generated in preceding module periods in the same sampling period as data for a waveform signal to be generated in a next module period; and said step of time-divisionally generating said plurality of waveform signals including:

generating various types of waveform signals, the types of which is selected by an input signal (C4~C6);

generating a normal address signal which changes at a substantially uniform rate corresponding to a selected frequency; and selectively supplying one of (i) said normal address signal and (ii) said waveform signal or said sum of waveform signals as an address signal for use in generating said various types of waveform signals.

27. A method of generating a waveform for an electronic musical instrument, comprising:

generating, in a waveform generating means, a plurality of waveform signals on a time divisional basis for a unit sampling period, said unit sampling period being divided into a plurality of module periods;

generating a normal address signal which changes at a substantially uniform rate corresponding to a selected frequency;

selectively supplying said waveform generating means with one of (i) said normal address signal, (ii) a waveform signal, and (iii) a sum of waveform signals already generated in preceding module periods in the same sampling period as address data for a waveform signal to be generated in a next module period; and generating various waveform signals responsive to a selection input signal which designates various types of said various waveform signals, and said various waveform signals being generated based on said signals selectively supplied to said waveform generating means.

28. A method of generating a waveform for an electronic musical instrument, comprising:

generating, in a waveform generating means, a plurality of waveform signals on a time divisional basis for a unit sampling period, said unit sampling period being divided into a plurality of module periods; and supplying said waveform generating means with at least one of a waveform signal and a sum of waveform signals already generated in preceding module periods in the same sampling period as data for a waveform signal to be generated in a next module period; and said step of time-divisionally generating said plurality of waveform signals, including:

generating various types of waveform signals, the types of which is selected by an input signal;

generating a normal address signal which changes at a substantially uniform rate corresponding to a selected frequency; and selectively supplying one of (i) said normal address signal and (ii) said waveform signal or said sum of waveform signals as an address signal for use in generating said various types of waveform signals.

29. A waveform generator for an electronic musical instrument, comprising:

control means for controlling a waveform generation on a time division basis;

waveform generating means controlled by said control means for time-divisionally generating a plurality of waveform signals in a unit sampling period, said unit sampling period being divided into a plurality of module periods, and each of said module periods being divided into a plurality of channel periods; and selective operating means coupled to said waveform generating means for supplying said waveform generating means with at least one of a waveform signal and a sum of waveform signals already generated in preceding module periods in the same sampling period as data for a waveform signal to be generated in a next module period; and said waveform generating means including:

waveform memory means for storing a predetermined waveform, said waveform memory means including a waveform memory for storing a sine waveform signals;

address signal generating means for producing a normal address signal which changes at a substantially uniform rate corresponding to a selected frequency;

controllable modifying means coupled to said waveform memory means and to said control means for selectively changing an input signal to form a modified signal, said modified signal having an amplitude changing rate different from that of the input signal;

selecting means for selectively supplying at least one of (i) the normal address signal generated by said address signal generating means and (ii) the waveform signal or the sum of waveform signals delivered from said selective operation means as said input signal to said controllable modifying means, and said modified signal produced by said controllable modifying means being supplied to said waveform memory means as an address signal, said selecting means including data inputs;

adding means for adding a waveform signal output from said waveform memory and a waveform signal previously output therefrom; and linking means for linking the output from said adding means to one of said data inputs of said selecting means.

30. A waveform generator for an electronic musical instrument, comprising:

control means for controlling a waveform generation on a time division basis;

waveform generating means controlled by said control means for time-divisionally generating a plurality of waveform signals in a unit sampling period, said unit sampling period being divided into a plurality of module periods, and each of said module periods being divided into a plurality of channel periods; and selective operating means coupled to said waveform generating means for supplying said waveform generating means with at least one of a waveform signal and a sum of waveform signals already generated in preceding module periods in the same sampling period as data for a waveform signal to be generated in a next module period; and said waveform generating means including:

various waveform signal generating means for generating various types of waveform signals, the types of which are selected by an input signal (C4~C6), said various waveform signal generating means including waveform memory means for storing a sine waveform signal;

address signal generating means for generating a normal address signal which changes at a substantially uniform rate corresponding to a selected frequency;

selecting means for selectively supplying at least one of (i) the normal address signal generated by said address signal generating means and (ii) the waveform signal or the sum of waveform signals delivered from said selective operation means as an address signal of said various waveform signal generating means, and said selecting means including data inputs;

adding means for adding a waveform signal output from said waveform memory and a waveform signal previously output therefrom; and linking means for linking the output from said adding means to one of said data inputs of said selecting means.

31. A waveform generator for an electronic musical instrument, comprising:

waveform generating means for generating a plurality of waveform signals on a time divisional basis for a unit sampling period, said unit sampling period being divided into a plurality of module periods; and supplying means coupled to said waveform generating means for supplying said waveform generating means with at least one of a waveform signal and a sum of waveform signals already generated in preceding module periods in the same sampling period as data for a waveform signal to be generated in a next module period; and said waveform generating means including:

various waveform signal generating means for generating various types of waveform signals, the types of which are selected by an input signal, said various waveform signal generating means including waveform memory means for storing a sine waveform signal;

address signal generating means for generating a normal address signal which changes at a substantially uniform rate corresponding to a selected frequency;

selecting means for selectively supplying at least one of (i) the normal address signal generated by said address signal generating means and (ii) the waveform signal or the sum of waveform signals delivered from said supplying means as an address signal of said various waveform signal generating means, said selecting means including data inputs;

adding means for adding a waveform signal output from said waveform memory means and a waveform signal previously output therefrom; and linking means for linking the output from said adding means to one of said data inputs of said selecting means.

32. A method of generating a waveform for an electronic musical instrument, comprising:

controlling generation of a waveform on a time division basis;

time-divisionally generating, in a waveform generating means, a plurality of waveform signals in an unit sampling period, said unit sampling period being divided into a plurality of module periods, and each of said module periods being divided into a plurality of channel periods; and supplying said waveform generating means with at least one of a waveform signal and a sum of waveform signals already generated in preceding module periods in the same sampling period as data for a waveform signal to be generated in a next module period; and said step of time-divisionally generating said plurality of waveform signals including:

storing a predetermined waveform including a sine waveform signals in a waveform memory means; and adding a waveform signal output from said waveform memory means and a waveform signal previously output therefrom;

producing a normal address signal which changes at a substantially uniform rate corresponding to a selected frequency;

selecting changing an input signal to form a modified signal, the amplitude changing rate of said modified signal being different from that of the input signal; and selectively supplying at least one of (i) said normal address signal and (ii) said waveform signal or said sum of the waveform signals as said input signal which is selectively changed to form said modified signal, and supplying said modified signal to said waveform memory means as an address signal.

* * * * *